United States Patent [19]

Menth et al.

[11] 4,099,995

[45] Jul. 11, 1978

[54] COPPER-HARDENED PERMANENT-MAGNET ALLOY

[75] Inventors: Anton Menth, Nussbaumen; Hartmut Nagel, Baden; Antony James Perry, Nussbaumen, all of Switzerland

[73] Assignee: BBC Brown, Boveri & Company, Ltd., Baden, Switzerland

[21] Appl. No.: 806,336

[22] Filed: Jun. 14, 1977

Related U.S. Application Data

[63] Continuation of Ser. No. 598,588, Jul. 24, 1975, abandoned.

[30] Foreign Application Priority Data

Jul. 31, 1974 [CH] Switzerland ..... 10559/74

[51] Int. Cl.[2] ..... H01F 1/02

[52] U.S. Cl. ..... 148/101; 75/152; 148/31.57; 148/102; 148/103

[58] Field of Search ..... 148/31.57, 101, 102, 148/105, 103; 75/152

[56] References Cited

U.S. PATENT DOCUMENTS

| | | | |
|---|---|---|---|
| 3,560,200 | 2/1971 | Nesbitt et al. | 148/31.57 |
| 3,684,593 | 8/1972 | Benz et al. | 148/102 |
| 3,790,414 | 2/1974 | Tawara et al. | 148/31.57 |
| 3,839,102 | 10/1974 | Tawara et al. | 148/102 |
| 3,844,850 | 10/1974 | Benz | 148/103 |
| 3,947,295 | 3/1976 | Tawara et al. | 148/31.57 |

*Primary Examiner*—Walter R. Satterfield
*Attorney, Agent, or Firm*—Oblon, Fisher, Spivak, McClelland & Maier

[57] ABSTRACT

A copper-hardened permanent-magnet alloy consisting of cobalt, copper and at least one of the rare-earth metals (RE) with atomic number 57 – 71, is characterized by a coarse-grained matrix of the composition Re $(Co_{1-y}Cu_y)_{6+X}$, wherein $0 \leqq X \leqq 1$ and $0.15 < y < 0.35$.

9 Claims, 3 Drawing Figures

COPPER-HARDENED PERMANENT-MAGNET ALLOY

This is a continuation of application Ser. No. 598,588, filed July 24, 1975 and now abandoned.

BACKGROUND OF THE INVENTION

1. Field of the Invention

This invention relates to a copper-hardened permanent-magnet alloy consisting of cobalt, copper and at least one of the rare earth metals (RE) having atomic numbers 57–71, and also to a method of producing such an alloy. This invention also relates to certain uses of this novel alloy.

2. Description of the Prior Art

In U.S. Pat. No. 3,560,200 (German Pat. No. 1,915,358) there is disclosed copper-hardened permanent-magnet alloys consisting of the components A (cobalt or iron), RE (at least one element from the group consisting of samarium, cerium, gadolinium, praseodymium, lanthanum, yttrium, neodymium and hafnium) and B (copper). In that reference, it is disclosed that hardening of the alloys with the nonmagnetic copper results in a considerable decrease in the wall movement of the magnetic domains, so that an increasing proportion of component B increases the coercive force. On the other hand, increasing the proportion of the magnetic component A (e.g., Co) improves the remanence of the alloy. However, in the above-mentioned patent the disclosed alloys, $(Co, Cu)_x Sm$ or $(Co, Cu)_x Ce$, with $x = 5$, 5.5, 6.24, 6.75 and 8.5, exhibit high values of coercive force, $H_C$, and remanence, $B_r$, only for $x = 5$ and then only after heat treatment. For many applications it would be most desirable to have magnetic alloys from which permanent magnets could be produced having optimal magnetic properties without concomitant increase in cost.

SUMMARY OF THE INVENTION

Accordingly, it is an object of this invention to provide a copper-hardened permanent-magnet alloy which not only exhibits optimal magnetic properties but also is producible by an inexpensive process and, in addition, is easily fabricated into permanent magnets.

This and other objects of the invention as will hereinafter be made clear by the ensuing discussion have been achieved by providing a copper-hardened permanent-magnet alloy which is a coarse-grained matrix of composition RE $(Co_{1-y}Cu_y)_{6+x}$, where $0 \leqq X \leqq 1$, $01.15 < y < 0.35$ and RE represents at least one of the rare earth metals having atomic numbers 57–71.

BRIEF DESCRIPTION OF THE DRAWINGS

Various other objects, features and attendant advantages of the present invention will be more fully appreciated as the same becomes better understood by reference to the following detailed description when considered in connection with the accompanying drawings, wherein.

DESCRIPTION OF THE PREFERRED EMBODIMENTS

Figure 1:
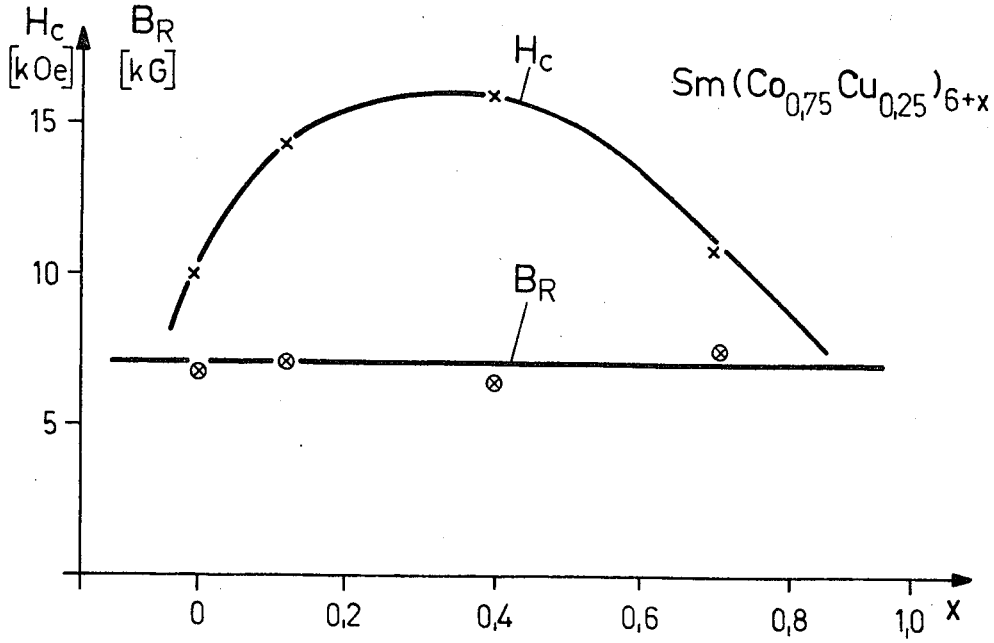
FIG. 1 shows the dependence of the coercive force Hc as well as the remanence Br on the samarium content in the alloy series $Sm(Co_{0.75}\,Cu_{0.25})_{6+X}$.

Copper-hardened permanent-magnet alloys of the composition and structure of this invention exhibit surprisingly high values of coercive force and remanence. In particular Hc and Br values up to 20 KOe and 10 kg, respectively, and energy products of over 20 MGOe have been obtained in samarium-hardened alloys. This result is all the more surprising since German Pat. No. 1,915,358 and the publication of E. A. Nesbitt, R. H. Willens, R. C. Sherwood, E. Buchler and J. H. Wernick in Applied Physics Letters 12,361 (June 1968) indicate that only $(Co, Cu)_5$ Sm-alloys are permanent-magnet materials with good magnetic characteristics. Moreover, this is surprising since it is well known in the art that only the $SmCo_5$ alloy, but not the $SmCo_6$ or $SmCo_{8.5}$ alloys, exhibits good magnetic properties.

Furthermore, the alloys fabricated in accordance with this invention not only have superior magnetic properties but, in addition, are significantly lower in cost of raw materials than for conventional alloys on account of the relatively small proportion of expensive rare-earth metals required.

The alloys of this invention are characterized by a coarse-grained matrix of a size of 1mm to 10cm in size, statistically distributed grains or an aligned solidified structure, each grain being a perfectly aligned permanent magnet. No significant improvements are made in the magnetic properties of the alloys by heat-treating them.

Additionally, it is surprising that in producing the copper-hardened permanent-magnet alloys by melting together the stoichiometrically weighed and mixed components—cobalt, copper and rare earth metal — at about 1400° C and subsequently cooling the melt, the cooling rate has been found to have no significant influence on the magnetic properties of the alloys.

All specimens of the copper-hardened permanent magnet alloys mentioned below were produced by melting together the elements cobalt, copper and samarium in an induction oven. The raw materials, 99.9% pure samarium, 99.9% pure cobalt and oxygen-poor, 99.999% pure, electrolytic copper, coarsely pulverized, were placed in a boron nitride crucible, and melted in a high-purity argon atmosphere at a temperature of about 1400° C.

The frequency of 10 KHz brings the liquid into rotation and provides for a thorough mixing. After 3–5 minutes of standing at melting temperature, the heat is discontinued and the melt is hardened in situ.

To obtain a material with coarse granular structure, the cooling speed should not be too rapid, especially in the temperature range between the beginning and end of the hardening step. At a cooling speed of 50°/min in this temperature range (for the disclosed material, between 1300° and 1200° C), one obtains a 3–5 mm coarse granular composition, in which an almost totally aligned permanent magnet is produced in every grain. The melt was allowed to solidify in situ with a cooling rate less than 50° C/min. The resulting material exhibited a matrix consisting of 3–5 mm grains, each of which was found to be almost a completely aligned permanent magnet. The crystallographic, and therewith also the magnetically preferred directions, of these grains were statistically distributed throughout the material. From the grains of this material, spherical, single-crystal samples of about 2 mm diameter were ground in a ball mill. The demagnetization curves of these spherical single crystals were obtained by means of a vibration magnetometer with a maximum field of 23 KOe. From these curves the coercive force Hc and the remanance Br were obtained. The compositions were determined by wet chemistry to an accuracy of 1%. The results of measurements on some of the alloys of the invention are given in the following table.

| Alloy | Composition (weight %) Sm | Co | Cu | Coercive Force $H_c$ [kOe] | Remanence Br [kG] |
|---|---|---|---|---|---|
| $Sm_{0.143}Co_{0.657}Cu_{0.20}$ $[Sm(Co_{0.77}Cu_{0.23})_6]$ | 29.46 | 53.11 | 17.43 | 7.4 | 6.8 |
| $Sm_{0.143}Co_{0.607}Cu_{0.25}$ $[Sm(Co_{0.71}Cu_{0.29})_6]$ | 29.36 | 48.92 | 21.72 | 14.3 | 6.8 |
| $Sm_{0.143}Co_{0.557}Cu_{0.30}$ $[Sm(Co_{0.65}Cu_{0.35})_6]$ | 29.27 | 44.75 | 25.98 | 19.6 | 5.3 |
| $Sm_{0.14}Co_{0.64}Cu_{0.22}$ $[Sm(Co_{0.75}Cu_{0.25})_{6.12}]$ | 28.94 | 51.85 | 19.22 | 14.3 | 7.1 |
| $Sm_{0.135}Co_{0.645}Cu_{0.22}$ $[Sm(Co_{0.75}Cu_{0.25})_{6.4}]$ | 28.08 | 52.58 | 19.34 | 16 | 6.5 |
| $Sm_{0.13}Co_{0.65}Cu_{0.22}$ $[Sm(Co_{0.75}Cu_{0.25})_{6.7}]$ | 27.21 | 53.33 | 19.46 | 10.8 | 7.4 |
| $Sm_{0.125}Co_{0.75}Cu_{0.125}$ $[Sm(Co_{0.80}Cu_{0.14})_7]$ | 26.49 | 62.30 | 11.20 | 3.2 | 9.7 |
| $Sm_{0.128}Co_{0.73}Cu_{0.142}$ $[Sm(Co_{0.84}Cu_{0.16})_{6.85}]$ | 26.95 | 60.37 | 12.68 | 5.3 | 9.1 |

Figure 2:
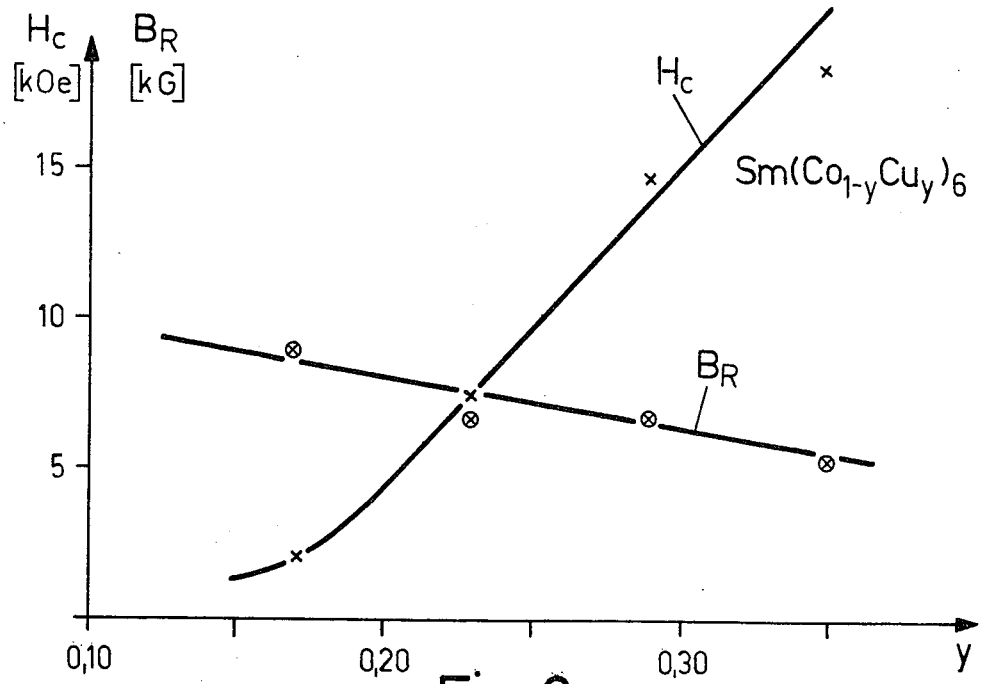
FIG. 2 shows the dependence of the coercive force Hc and remanence Br on the copper content in the alloy series $Sm(Co_{1-y}Cu_y)_6$.

In FIGS. 1 and 2 are plotted the coercive force and remanence of some of the samples in the alloy series $Sm(Co_{0.75}Cu_{0.25})_{6+X}$ and $Sm(Co_{1-y}Cu_y)_6$. In the alloy series $Sm(CO_{0.75}Cu_{0.25})_{6+X}$ the remanence remains almost constant over the range $0 \leqq X \leqq 1$ because of the fixed proportion of Co, while the coercive force which is relatively low at the ends of this range, climbs to surprisingly high values in the middle of it. By varying the copper content in this alloy series the magnetic properties can be improved further still. This is apparent from FIG. 2 in which the coercive force and remanence of the alloy series $Sm(Co_{1-y}Cu_Y)_6$ are plotted as functions of the copper content $y$. As can be seen, the remanence decreases as the copper content goes up since the copper atom in contrast to cobalt has no magnetic moment. On the other hand, the coercive force rises very steeply between $y = 0.15$ and $y = 0.35$. A material in which both the coervice force and the remanence are high in value, as in the range $y = 0.2$ to $y = 0.3$ in FIG. 2 for the alloy of this invention is especially suitable for magents.

Figure 3:
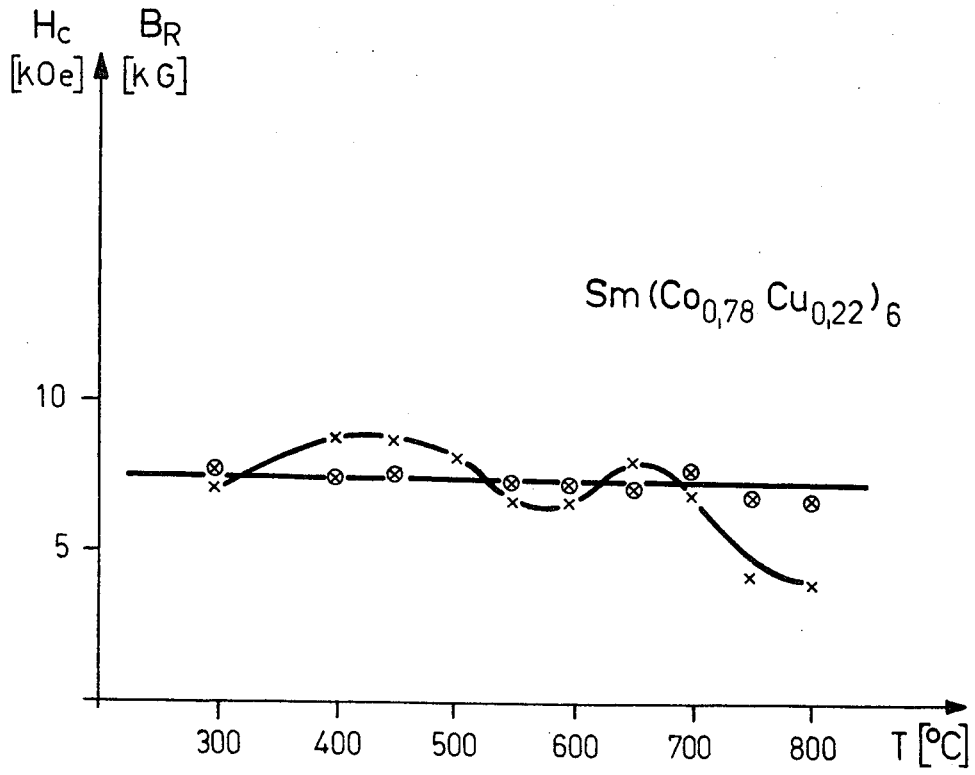
FIG. 3 shows the dependence of the coercive force Hc and the remanence Br on the annealing temperature T in an approximately 2 hour annealing of the alloy $Sm(Co_{0.78}Cu_{0.22})_6$.

The energy product of almost all samples lay above 9 MGOe and reached a maximum of about 20 MGOe in the alloy $Sm(CO_{0.84}CU_{0.16})_{6.85}$ In FIG. 3 using the alloy $Sm(Co_{0.78}Cu_{0.22})_6$ as an example, there is shown the dependence of the magnetic properties on the annealing temperature T after about a 2-hour heat treatment. It is seen that after heat treatment at 450° C there is a slight improvement in the coercive force. The coercive force also improves somewhat at 650° C, but at this temperature the alloy dissociates after several hours into a mixture of two phases.

Besides samarium any other rare-earth metals having atomic numbers from 57 to 71 can be used separately or in combination, e.g., Ce-mischmetal, as components of the alloys of this invention.

Two paths can be followed in producing arbitrarily large magnets from the coarse-grained permanent-magnet material of this invention obtained from the melt: (1) production of large single crystals by solidification alignment; or (2) pulverization of the coarse-grained materials followed by aligning, pressing and sintering of the powder. Through regulated solidification, either large single crystals are extracted, or in a powder-metallurgical method, sufficiently large magnetic bodies are prepared. By the powder-metallurgical method, the coarse grained material is first ground. In order to achieve a high density and also a small oxygen content in the ground material, a medium grain size of 4–20 m is advantageous. The best magnets are obtained at a grain size of 5 m. For magnetic alignment of the silicon formed powders which are drawn off, a magnetic field is necessary which is at least larger than the coercive field of the materials. In the disclosed process, in each case, a magnetic field of 40 KOe is used. The aligned powder will finally be compressed to a pressure of 6000 atm at about 60% of the theoretical density. The sinter-forming temperature must also be selected so that the density of the finished sintered magnets are 98% of the theoretical density. In the disclosed materials, the necessary sinter-forming temperature is between 1140° C and 1100° C, whereby the sinter-forming temperature is a function of the chemical composition of the materials. In the latter powder-metallurgical method of fabricating magnets, the alloy of this invention offers a distinct advantage in that the particle size of the powder obtained by grinding in a mill is not critical. This occurs because the magnetic properties of the materials of the invention are produced by dispersion hardening, and cannot thereafter be changed by domain formation and domain-boundary motions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A coarse-grained, copper-hardened permanent-magnet alloy having the formula $$Sm(Co_{1-y}Cu_y)_{6+x},$$

wherein $0 \leqq x \leqq 1$, and $0.15 < y < 0.35$, which is prepared by a process which comprises melting together the mixed components cobalt, copper, and samarium in weight proportions according to the final desired formula:

holding the melt at a temperature of about 1400° C for from 3 to 5 minutes: and subsequently solidifying the melt in situ by applying a cooling rate of less than 50° C/min. within the solidification temperature range of between 1300° C and 1200° C.

2. The copper hardened permanent magnet alloy of claim 1, which has the approximate composition $Sm(Co_{1-y}Cu_y)_6$, wherein $0.15 < y < 0.35$.

3. The copper-hardened permanent-magnet alloy of claim 1, which has the approximate composition $Sm(Co_{0.75}Cu_{0.25})_{6+x}$, wherein $0 \leqq x \leqq 1$.

4. The alloy of claim 1 wherein said process further comprises heat treating said copper-hardened permanent-magnet alloy at a temperature between about 450° C and 650° C for about 2 hours, after said solidifying step.

5. The alloy of claim 1 wherein said process further comprises, after said solidifying step, comminuting and grinding the resultant copper-hardened permanent magnet alloy under an inert gas atmosphere to a particle size of from 4 to 20 μm;

aligning it in a magnetic field of up to 40 kOe;

compressing it to about 60% of its theoretical density at a pressure of 6000 atm; and then sintering it at a temperature between 1140° C and 1100° C.

6. A coarse-grained, copper-hardened permanent-magnet alloy having the formula $$Sm(Co_{1-y}Cu_y)_{6+x},$$

wherein $0 \leqq x \leqq 1$, and $0.20 \leqq y \leqq 0.30$, which is prepared by a process which comprises melting together the mixed components cobalt, copper, and samarium in weight proportions according to the final desired formula;

holding the melt at a temperature of about 1400° C for from 3 to 5 minutes: and subsequently solidifying the melt in situ by applying a cooling rate of less than 50° C/min. within the solidification temperature range of between 1300° C and 1200° C.

7. A method of preparing a coarse-grained, copper-hardened permanent-magnet alloy having the formula $$Sm(Co_{1-y}Cu_y)_{6+x},$$

wherein $0 \leqq x \leqq 1$, and $0.15 < y < 0.35$, which comprises:

melting together the mixed components cobalt, copper, and samarium in weight proportions according to the final desired formula;

holding the melt at a temperature of about 1400° C for from 3 to 5 minutes: and subsequently solidifying the melt in situ by applying a cooling rate of less than 50° C/min. within the solidification temperature range of between 1300° C and 1200° C.

8. The method of claim 7, wherein the copper-hardened permanent magnet alloy is further pulverized, aligned in a magnetic field, pressed and then solidified by sintering.

9. A permanent magnetic made from the alloy of claim 1.

* * * * *